US007219377B2

(12) United States Patent
McMahan

(10) Patent No.: US 7,219,377 B2
(45) Date of Patent: May 22, 2007

(54) METHOD FOR POSITIONING A ROLLER WITHIN A HEADBOARD OF A PATIENT TRANSPORT SYSTEM

(75) Inventor: Robert L. McMahan, Cedar Park, TX (US)

(73) Assignee: Barton Medical Corporation, Austin, TX (US)

( * ) Notice: Subject to any disclaimer, the term of this patent is extended or adjusted under 35 U.S.C. 154(b) by 0 days.

(21) Appl. No.: 11/454,024

(22) Filed: Jun. 15, 2006

(65) Prior Publication Data

US 2006/0230527 A1 Oct. 19, 2006

Related U.S. Application Data

(62) Division of application No. 10/789,952, filed on Feb. 27, 2004, now Pat. No. 7,062,803.

(60) Provisional application No. 60/450,293, filed on Feb. 27, 2003.

(51) Int. Cl.
*A61G 7/10* (2006.01)

(52) U.S. Cl. ..... 5/81.1 R; 5/88.1

(58) Field of Classification Search ..... 5/88.1, 5/81.1 R, 83.1, 86.1, 84.1, 53.1, 81.1 HS See application file for complete search history.

(56) References Cited

U.S. PATENT DOCUMENTS

| | | | | |
|---|---|---|---|---|
| 481,757 | A | 8/1892 | Hamblin | |
| D78,867 | S | 6/1929 | Stuart | |
| 2,061,588 | A | 11/1936 | Peschel | |
| 3,108,290 | A | 10/1963 | Partridge | |
| 3,383,717 | A * | 5/1968 | Underwood | 5/612 |
| 5,697,109 | A | 12/1997 | Hodgetts | |
| 5,819,339 | A | 10/1998 | Hodgetts | |
| D408,647 | S | 4/1999 | Zaidman | |
| 5,996,144 | A | 12/1999 | Hodgetts | |
| 6,289,533 | B1 | 9/2001 | Hodgetts | |
| D469,285 | S | 1/2003 | Stanton | |
| 6,507,963 | B2 | 1/2003 | Hodgetts | |
| 6,591,435 | B1 | 7/2003 | Hodgetts | |
| 6,701,546 | B2 | 3/2004 | Hodgetts | |
| D497,749 | S | 11/2004 | Mohundro | |

* cited by examiner

*Primary Examiner*—Alexander Grosz
(74) *Attorney, Agent, or Firm*—The Webb Law Firm

(57) ABSTRACT

Disclosed is a method for using a bedstead board attached to a bed to support a roller of a patient transport system. A recess extends into the bedstead board and is spaced a distance from the side of the board. The recess retains a roller sufficiently to withstand forces acting upon the roller.

6 Claims, 3 Drawing Sheets

METHOD FOR POSITIONING A ROLLER WITHIN A HEADBOARD OF A PATIENT TRANSPORT SYSTEM

CROSS-REFERENCE TO RELATED APPLICATIONS

This application is a divisional of application Ser. No 10/789,952 filed Feb. 27, 2004, entitled "Furniture Headboards and Footboards", and issued on Jun. 20, 2006 as U.S. Pat. No. 7,062,803, which claims the benefit of U.S. Provisional Application No. 60/450,293, filed Feb. 27, 2003.

BACKGROUND OF THE INVENTION

1. Field of the Invention

This invention relates to bedstead boards (i.e., a headboard and footboard), and more particularly, to a headboard and footboard for a patient bed which cooperate with a patient transport system for transferring an immobile patient from the bed to a stretcher or vice versa.

2. Description of Related Art

It appears to be widely accepted that a major, if not the major, work-related complaint among nurses and hospital nursing staff is back injuries caused by lifting patients and getting them in and out of a bed and to and from a gurney or a stretcher as it is commonly referred to. A survey of existing practices and techniques suggests that there is no widely adopted simple and safe method of transferring patients from a bed to a stretcher, or vice versa, without lifting them. There are hoist-type lifts where the patient is suspended in a sling. The sling must be first manipulated under the patient and then the patient must be physically lifted, changing the shape of the body and applying pressures different from those existing on the patient when lying prone in bed. There are also roller boards which are inserted partially under the patient and then the patient is pulled onto the roller board. Again, the patient must be manipulated to allow the board to be inserted and then the body is pulled onto the board. In the end, the patient ends up on the board, not on the stretcher or the bed. An additional disadvantage of the roller board is that either the patient must cooperate with the transferrer or more than one transferrer is required to effect the transfer. Patients have also been known to drop off the roller boards and to land on the floor between the bed and the stretcher.

U.S. Pat. No. 5,819,339, which is hereby incorporated by reference, solves this age-old problem of transferring patients from a bed or a stretcher and vice versa. U.S. Pat. No. 5,819,339 discloses an apparatus for transporting a patient and includes a base, a patient supporting member attached to the base, a conveyor attached to the base, and a removable sheet. The sheet has a first end and a second end where the sheet first end is removably attached to the conveyor and the sheet second end is free. The sheet is adapted to be positioned on the patient supporting member, such as a mattress. In operation, an end of the sheet, which is attached to the conveyor, is rotated around a roller thereby moving the patient from the bed to a stretcher or vice versa.

However, the conveyor disclosed in U.S. Pat. No. 5,819,339 requires that the roller remain affixed to the bed or stretcher, or the complete conveyor be removed from the bed or stretcher. This results in a problem of storing the conveyor in a hospital room and transporting the conveyor when it is not attached to the bed or stretcher.

Further, typically, hospital beds vary in length and, in many cases, can be adjusted so that their lengths vary. In this case, a conveyor, such as that disclosed in U.S. Pat. No. 5,819,339, may be inoperative if the length of the roller is different from that of the bed. Further, if the length of the bed is varied during operation, then such a fixed length roller could affect the operation of the bed.

The problems associated with the invention of U.S. Pat. No. 5,819,339 were solved by the inventions disclosed in U.S. Pat. Nos. 5,697,109; 6,289,533; 5,996,144; and 6,507,963, which are hereby incorporated by reference. Namely, these patient transport systems accommodate various bed lengths with one conveying apparatus by providing a roller adjustable in length that can be easily engaged with and removed from a bed or stretcher through attachment (or clamping) assemblies. However, the attachment assemblies of these inventions can be cumbersome and difficult to use. Additionally, a bed or stretcher may have a geometry not conducive to accepting the attachment assembly. Furthermore, the various parts of the attachment assembly increase the cost of the patient transport system.

Therefore, it is an object of the present invention to provide a patient bed that accommodates (i.e., removably receives) a conveyor typical of a patient transport system as described above, namely, a patient transport system that allows a patient, while lying in a prone position and completely immobile, to be moved, by one person of relatively low strength, safely from the patient bed to a stretcher and vice versa.

BRIEF SUMMARY OF THE INVENTION

A bedstead board for a bed includes at least one recess near a first or a second side. The at least one recess is configured to removably receive a roller of a patient transport system. In use, two bedstead boards are connected to a bed frame. Each of the two bedstead boards includes at least one recess, with the at least two recesses aligning to receive a roller of the patient transport system to be parallel to a longitudinal axis of the bed. Preferably, the at least one recess is tilted from vertical such that the roller will not tend to dislodge from the at least one recess during use.

DETAILED DESCRIPTION OF THE INVENTION

Figure 1:
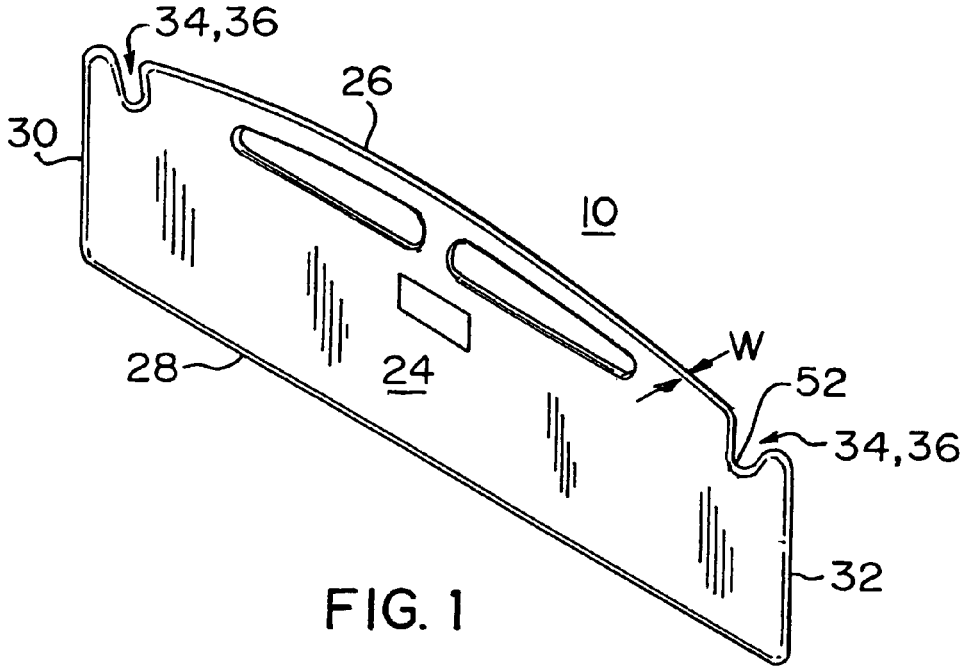
FIG. 1 is perspective view illustration of a bedstead board (i.e., a headboard or a footboard) according to the present invention.

A complete understanding of the invention will be obtained from the following description when taken in connection with the accompanying drawing Figures, wherein like reference characters identify like parts throughout.

For purposes of the description hereinafter, the terms "upper", "lower", "right", "left", "vertical", "horizontal", "top", "bottom", and derivatives thereof shall relate to the invention as it is oriented in the drawing Figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 2:
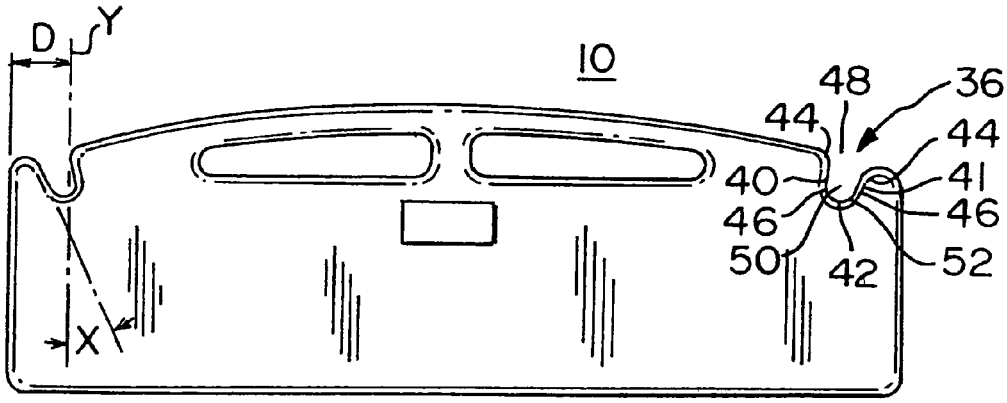
FIG. 2 is a front view illustration of the bedstead board shown in FIG. 1.
Figure 3:
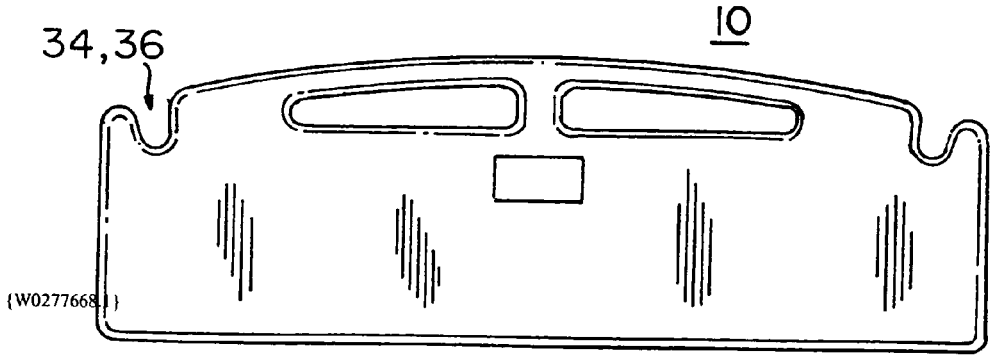
FIG. 3 is another front view illustration of the bedstead board shown in FIG. 1.
Figure 4:
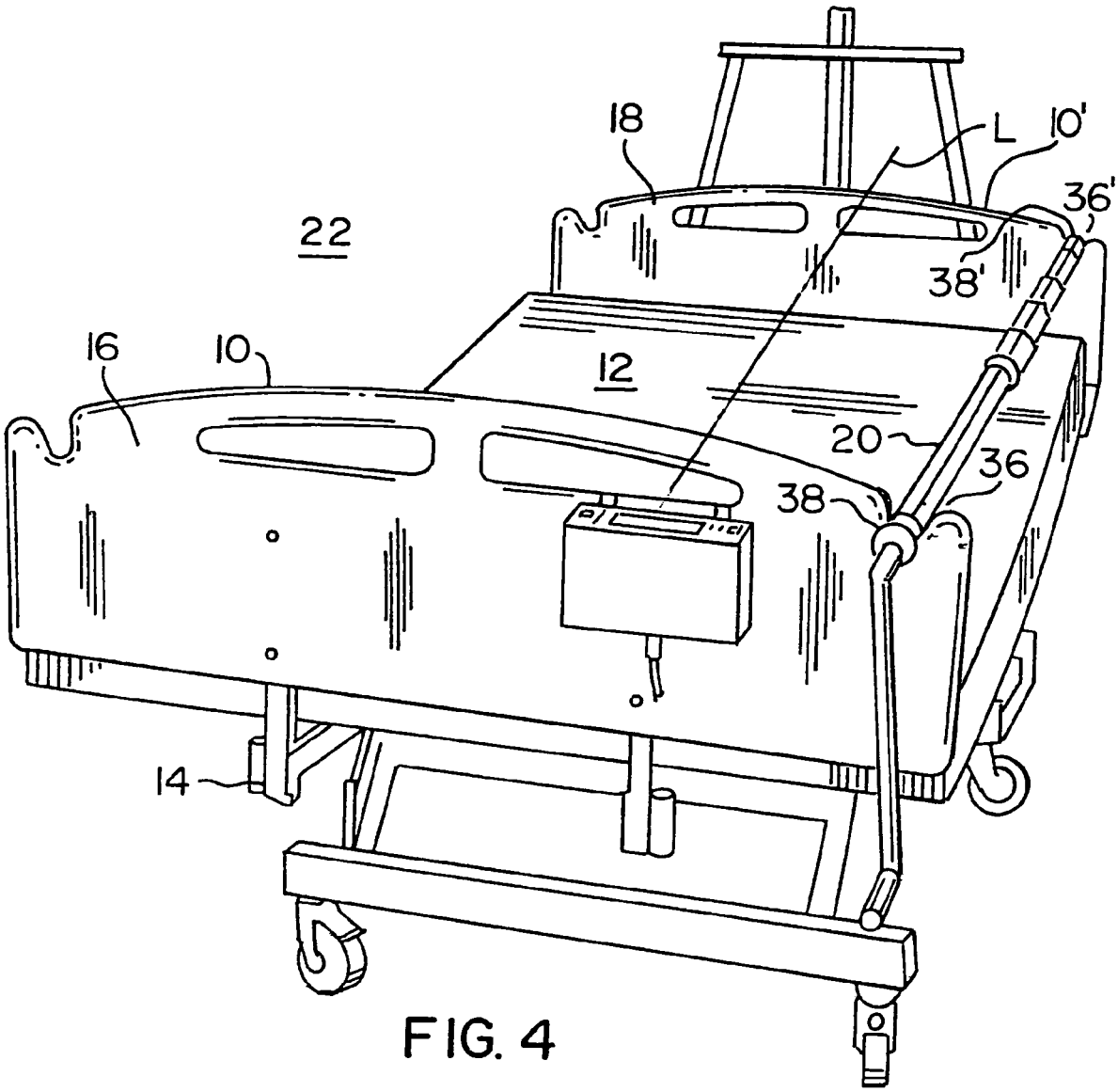
FIG. 4 is a copy of a perspective view of a bed including a pair of bedstead boards according to the present invention and a conveyor of a patient transport system.
Figure 5:
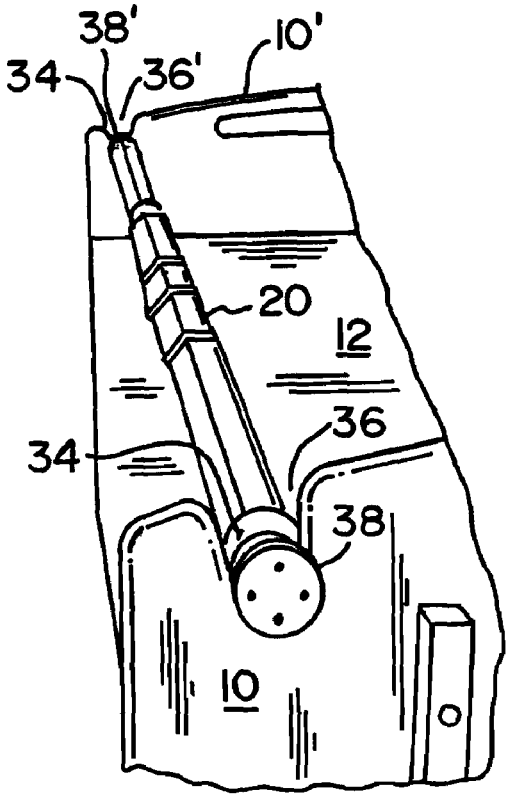
FIG. 5 is a copy of a perspective view of a partial back view of the bed shown in FIG. 4.

Referring to FIGS. 1–5, the present invention is a bedstead board 10 for a bed 12 (FIGS. 4, 5). Briefly directing attention to FIGS. 4 and 5, the bedstead board 10 is configured to attach to a frame 14 of the bed 12. Preferably, in use, the two bedstead boards 10 are attached to the frame 14, one at a head 16 of the frame 14 (a headboard) and another at a foot 18 of the frame 14 (a footboard).

The bedstead board 10 may be of any decorative or functional shape, as desired, and has a width W (FIG. 1). For ease of illustration, it is assumed that the bedstead board 10 is generally rectangular. The width W must be sufficient to support a conveyor 20 (FIGS. 4, 5) of a patient transport system 22 and the associated patient (not shown) during use of the system 22.

Directing attention to FIGS. 4 and 5, two bedstead boards 10, 10' include at least one recess 36, 36' aligned to receive the rollers 38, 38' of the conveyor 20 of the patient transport system 22 to be parallel to a longitudinal axis L of the system 22.

Directing attention to FIGS. 1–3, the bedstead board 10 includes a body 24 having a top 26 and an opposed bottom 28. The body 24 also has a first side 30 and an opposed second side 32. The bedstead board also includes at least one roller holder 34 configured to removably accept a roller 38 of the patient transport system 22.

The at least one roller holder 34 is preferably a recess 36 configured to removably accept the roller 38 (FIGS. 4, 5). The at least one recess 36 extends from the top 26 toward the bottom 28 (i.e., into the body 24 of the bedstead board 10). The at least one recess 36 is spaced a distance D from either the first side 30 or the second side 32 which side is referred to as the associated side. Preferably, the bedstead board 10 includes two recesses 36, one recess 36 spaced in from the first side 30 and another recess 36 spaced in from the second side 32.

The at least one recess 36 is preferably U-shaped with an inner wall 40 and an outer wall 41 extending from a base 42. Tops 44 of the walls 40, 41 distal the base 42 are preferably spaced further apart than bottoms 46 of the walls 40, 41 proximate the base 42. Thus, the receiving space 48 for receiving the roller 38 in the recess 36 is larger than the seating space 50 where the roller 38 will seat in the recess 36. This configuration requires less precise alignment when placing the roller 38 (FIGS. 4, 5) in the recess 36, thereby providing for easier installation of the conveyor 20.

The at least one recess 36 includes a bearing surface 52. The bearing surface 52 supports the roller 38 and provides a surface on which the roller 38 rotates. The bearing surface 52 is generally C-shaped, accounting for the base 42 and portions of the two walls 40, 41 of the U-shape, to accommodate the roller 38.

The inner wall 41 of the at least one recess 36 is preferably tilted at an angle X from a vertical axis Y such that the inner wall 41, as it extends upwardly from the base 42, extends outwardly toward the nearest of the first side 30 or the second side 32. When the conveyor 20 is used to transport a patient to and from the bed 12, forces from the patient and a sheet (i.e., a bed sheet) upon which the patient is lying act upon the roller 38 and transfer to the at least one recess 36. Essentially, the forces will tend to pull the roller 38 toward the patient, or, put another way, away from the nearest of the first side 30 or the second side 32. Thus, the angle X of the tilt of the at least one recess 36 aids in inhibiting the roller 38 from dislodging from the at least one recess 36 during use.

Figure 6:
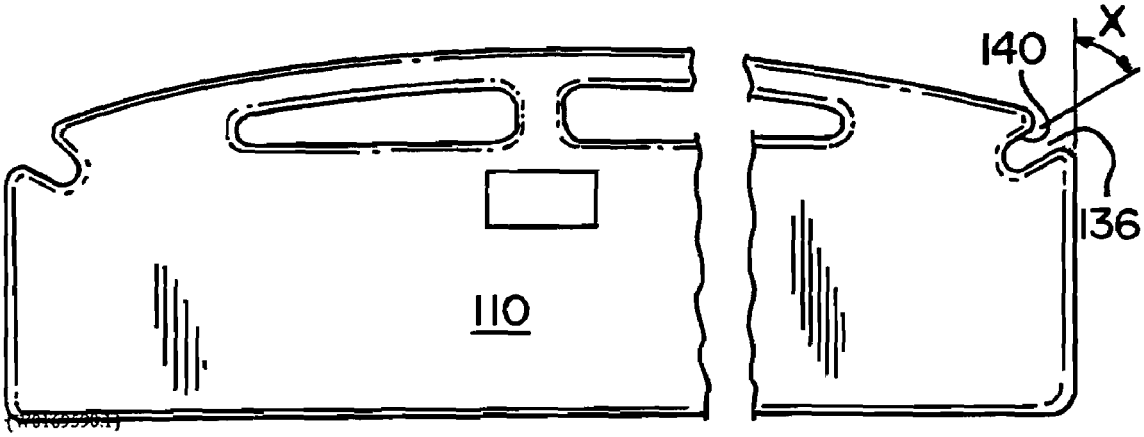
FIG. 6 is a front view of a second embodiment of the bedstead in accordance with the subject invention.

As illustrated in FIG. 2, the angle X of the inner wall 40 is approximately 10 degrees. Depending upon the forces acting to pull the roller 38, the angle X may be increased. FIG. 6 illustrates bedstead board 110 having a recess 136 with an inner wall 140 at an angle X with a vertical axis Y of about 60 degrees. Therefore, the recess 36, 136 may have an inner wall 40, 140 with an angle X that is between approximately 10–60 degrees.

Figure 8:
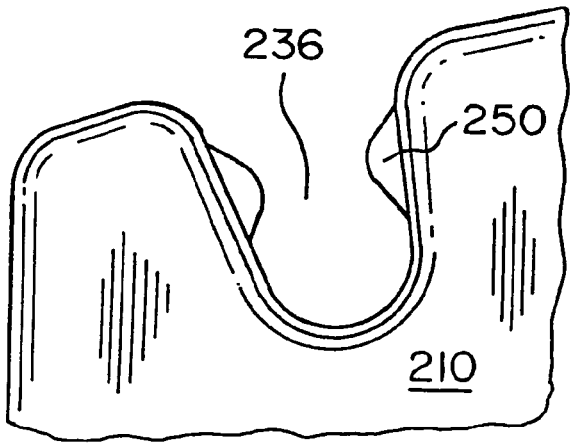
FIG. 8 is a back view of a portion of the bedstead shown in FIG. 7.
Figure 7:
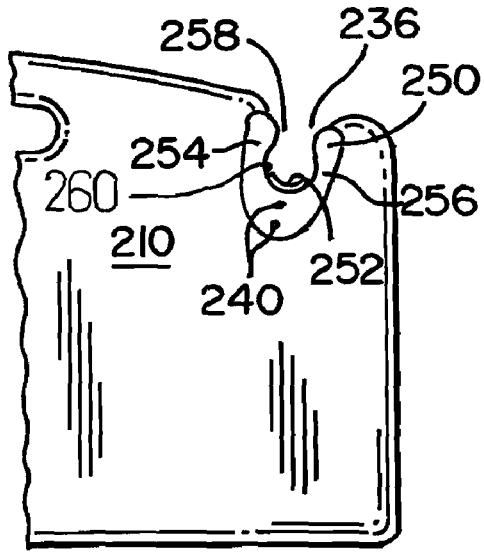
FIG. 7 is a front view of a third embodiment of a portion of the bedstead in accordance with the subject invention.

In another embodiment, illustrated in FIGS. 7 and 8, the bedstead board 210 may have a recess 236, similar to those recesses previously described but further including a clip 250 having a resilient section 252 with opposing legs 254, 256 wherein at least one of the legs 254, 256 is resiliently movable from the other leg. The legs 254, 256 define a gap 258 which in a relaxed position has a width less than the width of a roller 38 (FIG. 5) and in an expanded position has a width equal to or greater than the width of the roller 38 such that the roller 38 may be snapped into and held within the recess 236. The clip 250 may be secured to the bedstead board 210 by bolts 240. The clip 250 may be made from plastic, steel or any other structural material that provides sufficient resilient stiffness to retain the roller 38 under operating conditions. When the clip 250 is utilized, the angle X between the inner wall 240 of the recess 236 and the vertical axis Y is not as significant and may be selected in view of the retention that will be offered by the clip 250.

The clip 250 may have a base 260 upon which the roller 38 may rest.

It will be understood by those skilled in the art that while the foregoing description sets forth in detail preferred embodiments of the present invention, modifications, additions, and changes might be made thereto without departing from the spirit and scope of the invention.

The invention claimed is:

1. A method for using a bedstead board attached to a bed, comprising the step of positioning a roller of a patient transport system in at least one recess of the bedstead board, wherein the recess is spaced a distance from a side of the board and wherein the roller has a thickness and is retained within the recess sufficiently to withstand forces acting upon the roller, wherein the recess has an outer wall and an inner wall adjacent to a base with a distance therebetween, wherein the distance across the entire recess between the walls is at least as large as the thickness of the roller so that the roller within the recess will contact and rest against the base, wherein the inner wall is farther from the associated side than the outer wall and, wherein the inner wall is a greater distance away from the associated side at the bottom of the body than at the top of the body, such that the force acting upon a roller tends to urge the roller further into the recess.

2. The method according to claim 1, wherein the recess further includes a clip that resiliently retains the roller within the recess.

3. A method for using a bedstead board attached to a bed for a patient transport system, wherein the board has a body with atop, a bottom opposed to the top, a first side, and a second side opposing the first side, wherein the method comprises the steps of:

a) positioning a roller of the patient transport system in two opposing recesses of the bedstead board, wherein the roller has a thickness and each recess is spaced a distance from a side of the board; and b) retaining the roller within the recess sufficiently to withstand forces acting upon the roller when the patient transport system is operating; wherein the recess has an outer wall and an inner wall adjacent to a base with a distance therebetween, wherein the distance across the entire recess between the walls is at least as large as the thickness of the roller so that the roller within the recess will contact and rest against the base, wherein the inner wall is farther from the associated side than the outer wall and, wherein the inner wall is a greater distance away from the associated side at the bottom of the body than at the top of the body, such that a force acting upon the roller will urge the roller further into each recess.

4. A method according to claim 3, wherein the recess include a clip such that a force acting upon the roller will urge the roller further into the clip.

5. A method for using a bedstead board attached to a bed, comprising the step of positioning a roller of a patient transport system in at least one recess of the bedstead board, wherein the recess is spaced a distance from a side of the board, wherein the roller is retained within the recess sufficiently to withstand forces acting upon the roller and, wherein the recess further includes a clip that resiliently retains the roller within the recess.

6. A method for using a bedstead board attached to a bed for a patient transport system, wherein the board has a body with atop, a bottom opposed to the top, a first side, and a second side opposing the first side, wherein the method comprises the steps of:

a) positioning a roller of the patient transport system in two opposing recesses of the bedstead board, wherein each recess is spaced a distance from a side of the board; and b) retaining the roller within the recess sufficiently to withstand forces acting upon the roller when the patient transport system is operating, wherein the recess further includes a clip that resiliently retains the roller within the recess.

* * * * *

UNITED STATES PATENT AND TRADEMARK OFFICE

CERTIFICATE OF CORRECTION

PATENT NO. : 7,219,377 B2
APPLICATION NO. : 11/454024
DATED : May 22, 2007
INVENTOR(S) : McMahan It is certified that error appears in the above-identified patent and that said Letters Patent is hereby corrected as shown below:

Column 5, line 9, Claim 3, “with atop” should read -- with a top --

Column 6, line 14, Claim 6, “with atop” should read -- with a top --

Signed and Sealed this

Thirteenth Day of November, 2007

JON W. DUDAS
*Director of the United States Patent and Trademark Office*